United States Patent [19]

Gardner et al.

[11] Patent Number: 4,571,849

[45] Date of Patent: Feb. 25, 1986

[54] APPARATUS FOR REMOVING LIQUID FROM THE GROUND

[76] Inventors: Philip D. Gardner, Myrtle Cottage, Wiveton, Holt; Robin H. Combe, Glandford Mill, Glanford, Holt; John H. Groom, 12 The Green, Binham, Fakenham; Kenneth J. Groom, Pausan, Ling Common, Coltishall, Norwich, all of Norfolk Island

[21] Appl. No.: 661,083

[22] Filed: Oct. 15, 1984

[30] Foreign Application Priority Data

Oct. 22, 1983 [GB] United Kingdom ..... 8328299
May 18, 1984 [GB] United Kingdom ..... 8412778

[51] Int. Cl.[4] ..... F26B 9/00

[52] U.S. Cl. ..... 34/79; 34/241; 34/243 R; 15/327 A; 15/345; 15/346

[58] Field of Search ..... 34/79, 241, 243 R; 15/327 A, 345, 346; 55/385 R, 442, DIG. 3

[56] References Cited

U.S. PATENT DOCUMENTS

| | | | |
|---|---|---|---|
| 1,899,704 | 2/1933 | Lutz | 15/345 |
| 2,505,378 | 4/1950 | Belgau et al. | 34/99 |
| 2,832,986 | 5/1958 | Seck | 15/327 A |
| 3,078,496 | 2/1963 | Doran et al. | 15/346 |
| 3,170,276 | 2/1965 | Hall | 15/327 A |
| 3,286,368 | 11/1966 | Thomas | 34/243 R |
| 3,324,846 | 6/1967 | Smith | 34/243 R |
| 3,495,932 | 2/1970 | Tuma | 15/345 |
| 4,341,540 | 7/1982 | Howerin | 55/DIG. 3 |

FOREIGN PATENT DOCUMENTS

| | | | |
|---|---|---|---|
| 0858760 | 8/1981 | U.S.S.R. | 15/346 |
| 1020123 | 5/1983 | U.S.S.R. | 15/327 A |

*Primary Examiner*—Larry I. Schwartz
*Assistant Examiner*—David W. Westphal
*Attorney, Agent, or Firm*—Neal J. Mosely

[57] ABSTRACT

A machine for removing liquid from an area of ground over which the liquid has spread, comprises a convex hood (11) with a flat tray (12) mounted inside it. A motor driven fan (14) blows a downdraft out of the tray's central aperture (16) across the underside of the tray and into an annular gap (13) between the hood and the tray. The travelling air supports the machine above the ground and also lifts any ground-lying liquid into the annular gap and deposits it in a chamber inside the hood.

6 Claims, 9 Drawing Figures

APPARATUS FOR REMOVING LIQUID FROM THE GROUND

FIELD OF THE INVENTION

The invention relates to drying apparatus and is specifically concerned with the problem of removing liquid from an area of ground over which the liquid has spread.

REVIEW OF ART KNOWN TO THE APPLICANTS

The problem of removing large areas of ground-lying liquid quickly and efficiently is well-known. The spectacle of golfing greens, cricket pitches and tennis courts being unplayable after a heavy downpour of rain is all too familiar. Equally familiar, and potentially far more dangerous, is a general inability to clear quickly large pools of fuel oil or other liquid chemicals which may have spilled on to the highway from a travelling tanker.

The simplest known way of clearing such liquid is to employ a large staff of persons to brush the liquid from the surface on which it lies. This is usually slow and inevitably expensive.

Another method sometimes resorted to is to use the downdraft from the rotor of one or more hovering helicopters to try to vapourise large pools of water in an effort to disperse the water as mist. This is disproportionately expensive and is of questionable efficiency.

Machines have been developed to try to overcome this problem. One such problem is known as the MOTOMOP and is currently made and sold in the United Kingdom by Motomop Limited of 2 The Crescent, Taunton, Somerset TAl 4EA. This is a power-driven machine which travels on ground-engaging wheels and propels a giant rotary sponge over the waterlogged areas of grassed sports pitches. The water collected by the sponge is held temporarily in a tank on the machine and is then piped out of machine.

However, the machine just described suffers from the disadvantage that the sponge must be replaced regularly, because it wears. Another disadvantage is that the weight of the machine, plus the weight of the water picked up and carried by it causes the wheels of the machine to sink into the already waterlogged grassed pitch and this can damage the pitch. Yet another disadvantage is that the machine was developed specifically to clear water from grassed sports pitches and its applicability, if any, to other surfaces is not proven.

SUMMARY OF THE INVENTION

According to the present invention a machine for removing liquid from an area of ground over which the liquid has spread comprises:

(a) a hood, essentially unapertured and generally dished to define in use the top and sides of the machine;

(b) a tray, generally flat, with an aperture at its centre;

(c) means mounting the tray within the hood to define, in use, the underside of the machine and with an annular gap maintained between the periphery of the tray and the periphery of the hood;

(d) a motor driven fan mounted at the centre of, and inside, the hood and drawing the air from the annular gap and across the inside of the machine to blow in a down draft towards the tray's central aperture;

(e) a wall, formed around the periphery of that central aperture and rising towards the fan to duct the fan-blown air through the aperture and across the underside of the machine towards the annular gap;

(f) another wall, formed around the tray periphery and rising therefrom to duct the air entering the annular gap upwardly towards the underside of the hood;

(g) a chamber, defined between the tray walls, to receive liquid drawn with the air into the annular gap and carried over the tray's peripheral wall; and (h) means maintaining a passage for the in-drawn air to blow over the top of the peripheral tray wall across the inside of the machine and into the fan.

Such a machine does not rely on direct ground-engaging contact between any sponge or other liquid gathering means. Instead the liquid is propelled by the fan-blown air towards the annular gap and is then sucked up into the gap by the air circulating into and across the inside of the machine towards the fan. The operation of the machine is extremely efficient and virtually trouble free.

In a preferred embodiment of the invention, to be described in this specification, the fan-generated downdraft is such that the air blown through the tray aperture and across the underside of the machine constitutes the main or even the sole means supporting the underside of the machine above the ground in use. In other words the machine functions as a hovercraft. Such a machine leaves no wheeled tracks on the ground and can utilise the same fan and power unit to provide both the machine-supporting air cushion and the liquid-lifting air suction.

Preferably the liquid carried over the peripheral wall of the tray is positively prevented from travelling all the way across the inside of the machine and reaching the rotating fan. This stops the fan blades from getting wet and eventually rusting. It also maximises the liquid removing effect of the machine, whereas if a certain amount of liquid were recirculated by the fan then that effect would not be optimised.

Such means preventing the liquid from reaching the fan may comprise baffles which positively deflect the liquid into the liquid receiving chamber as it comes off the top of the peripheral tray wall. Suitable baffles can be incorporated whilst still maintaining the passage for the indrawn air to flow from the top of the peripheral tray wall across the inside of the machine and into the fan.

DESCRIPTION OF THE PREFERRED EMBODIMENT

Figure 1:
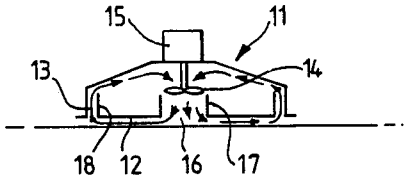
FIG. 1 shows in diagramatic cross-section the basic principle of operation of one machine embodying the invention.

The machine is essentially circular in plan and, when viewed from the side as in FIG. 1, is seen to comprise a generally convexly dished hood referenced 11 with a flat tray 12 mounted within it. The hood 11 defines the top and sides of the machine whilst the flat tray 12 defines the underside of the machine.

An annular gap 13 is deliberately maintained all the way round the machine between the periphery of the hood 11 and the periphery of the tray 12.

A fan 14 is mounted at the centre of the hood 11, and inside the hood. A motor 15 is mounted outside the hood and drives the fan 14. A central circular aperture 16 is formed in the tray 12 beneath the fan, and a cylindrical wall 17 is formed about the aperture 16 and rises as far as the fan to form a duct for downdraft created in use by the fan.

Another cylindrical wall 18 rises from the tray periphery toward the underside of the hood 11 but does not reach the underside of the hood. The walls 17, 18, together with the tray 12 define an annular chamber within the machine.

As the fan 14 rotates, it blows a downdraft of air in the directions indicated by the arrows in FIG. 1, i.e. through the aperture 16 and across the underside of the tray 12 towards the annular gap 13. Because a passage is effectively maintained between the gap 13 across the top of the tray wall 18 and across the underside of the hood 11 into the fan 16, the fan 14 sucks the air into the annular gap and so effectively recirculates the same volume of air through the machine.

The characteristics of this particular machine are such that the fan-generated downdraft is sufficient to lift the machine off the ground. If, therefore, the machine moves over a sheet of ground-lying liquid, the downdraft will blow the liquid towards the annular gap 13 and the liquid will then be drawn up into the machine and most or all of it will automatically be deposited into the chamber defined by parts 12, 17 and 18 as the air travels across the underside of hood 11 and into the fan 16.

The fan will also of course draw air into the annular gap 13 from regions immediately outside and adjacent the periphery of the machine. The same motor-driven fan in this way generates both the cushion of air upon which the machine travels and the suction air current lifting the ground-lying liquid into the machine.

Figure 2:
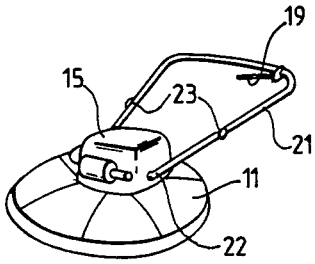
FIG. 2 shows the machine in perspective.

As FIG. 2 shows, the motor 15 is controlled by a trigger 19 linked by a conventional cable mechanism to the motor carburettor. The motor in this particular instance is an eight horse-power Briggs & Stratton air-cooled four-stroke 320 cc single cylinder petrol engine driving the fan 16 through a suitable bearing and coupling but without any reduction gearing in the drive train. A handle 21 swings about a horizontal axis 2 and enables the machine easily to be directed in a given arc or line of travel. The handle 21 is hinged about another horizontal axis 23 to fold back on itself and so take up the minimum of space when the machine is stowed or transported without being used.

Figure 3:
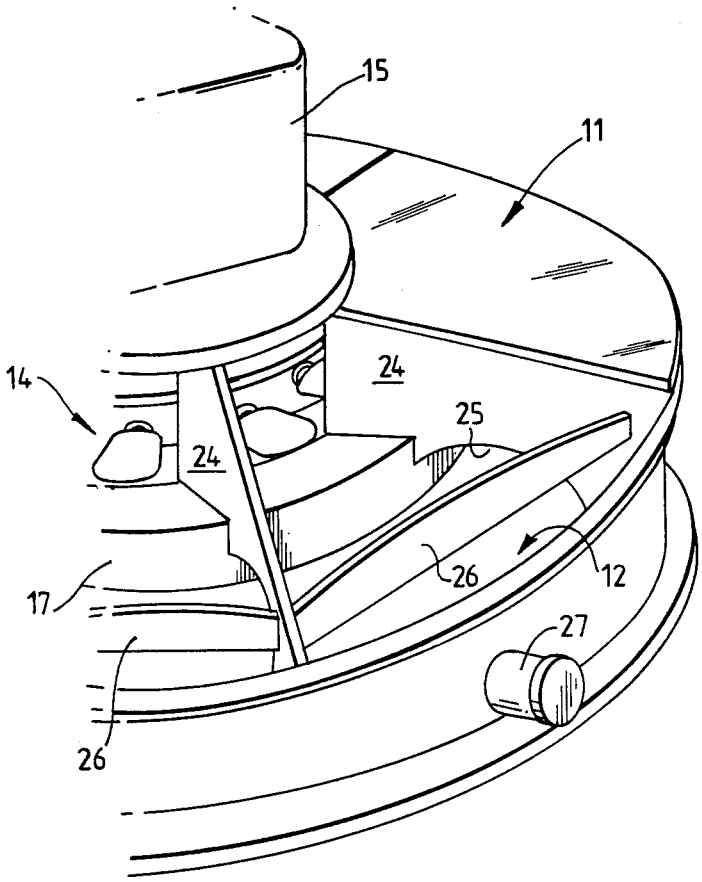
FIG. 3 is an enlarged perspective view of part of the machine, with part of the top removed.

As FIG. 3 shows, the top surface of hood 11 is divided into seven sectors. Each of these sectors can be removed to give access to the inside of the machine. Two of them have been removed in FIG. 3. Seven sectors are used because for most commercially practical sizes of machine this gives a sector panel which is neither too large to manipulate nor too small to form to the curvature of the machine hood.

Bulk heads 24 radiate from the centre of the hood. Archways 25 are cut out of these bulk heads so that the chamber defined between tray 12 and tray walls 17 and 18 is continuous around the inside of the machine. As shown, the top panels of the hood 11 rise up at approximately 15° from the horizontal when the machine is in normally intended attitude of use. The panels could rise at an angle of between 10° and 25° from the horizontal to give the desired effect which is for the air travelling off the top of tray wall 18 to experience a drop in pressure and hence to lose its "lift" on the liquid it has brought with it into the machine.

Figure 4:
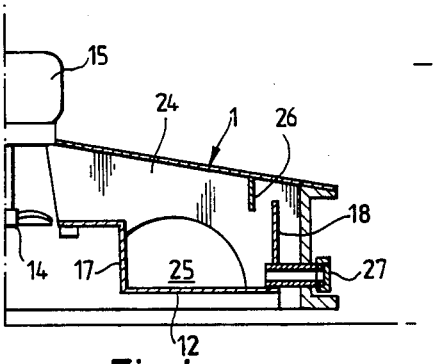
FIG. 4 is a side sectional view of the part of the machine shown in FIG. 3.

Baffles 26 span successive bulk heads 24 around the machine. As the liquid is drawn over the top of peripheral tray wall 18, it hits the baffles and is positively deflected in the liquid receiving chamber. Nevertheless, as FIG. 4 shows, a passage for the air across the underside of the machine and back into the fan is maintained.

Figures 5A, 5B, 5C:
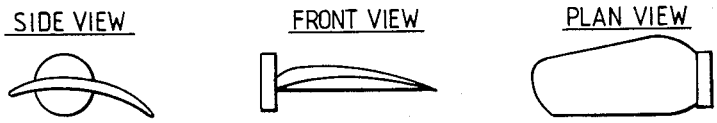
FIGS. 5(*a*), 5(*b*) and 5(*c*) show the blades of the fan used in the machine.

FIG. 5 shows one of the blades of the fan 14 in detail. This particular fan is a seven-bladed fan and is of the kind whereby the angle of attack of each blade can be varied. Preferably in the machine illustrated the angle of attack is about 35° to the horizontal. This angle might vary between 35° and 40° depending on the precise conditions in which any given machine is to be used. The prototype machine illustrated used the fan from an agricultural grain dryer.

The particular machine illustrated is approximately 4 feet in diameter, measured to the outer edge of the annular gap 13. The gap 13 itself is approximately 0.75 inches across and is constant around the machine. The distance between tray wall 18 and tray wall 17 is approximately 8.25 inches, and the fan 14 is 19 inches in diameter.

The tips of the fan blades are approximately 5.5 inches above the floor of the liquid receiving chamber as defined by tray 12. The periphery of the top region of hood 11 stands approximately 9 inches above tray 12, whilst the centre of the hood top on which the motor 15 is mounted stands approximately 12 inches above the floor of the tray 12.

A water outlet 27 is capped, as illustrated in FIGS. 3 and 4. When uncapped, virtually all the water from the inside chamber of the machine will drain away. Alternatively it can be pumped away via a suitable hose. It could be permanently pumped as the machine progresses over the waterlogged area, or alternatively the machine could be pumped out at intervals since its liquid receiving chamber is exceptionally large.

Figure 6:
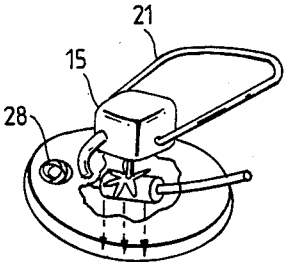
FIG. 6 shows diagramatically a modification to the machine.

In FIG. 6 the exhaust from the air-cooled petrol engine 15 is led into the machine and beneath fan 14 before merging again to discharge to atmosphere. The exhaust becomes hot in use, and the down draft from fan 14 will be heated and will have a vapourising effect on the liquid beneath the machine. This will increase the efficiency of the machine.

In FIG. 6 also, a vent 28 of the iris or camera shutter type is provided in one of the panels of the top of the hood 11 and is connected by a cable mechanism to a trigger (not shown) on handle 21. The vent is normally kept closed. It can be opened whenever it is desired to move the machine across an area where it is not necessary to suck up into the annular gap. For example, the machine could travel across a gravel path separating two waterlogged grassed pitches. In that situation, whilst the machine must still hover, it must not suck up the gravel into the liquid receiving chamber. The vent 28 would then be opened, and closed again once the machine was used in its liquid lifting mode.

Because the fan 14 draws its intake from the annular gap 16 in anything other than the vented mode just described, there is no appreciable horizontal "blow-out" of air about the machine's periphery. This has two advantages. First, the liquid over which the machine is moving will not be blown on to the machine operator or on to any nearby spectators. Second, it is not necessary to use any form of flexible skirt to try to contain the cushion of air on which the machine hovers. Such skirts are notoriously expensive and easily damaged when used on more conventional forms of hovering craft.

Figure 7:
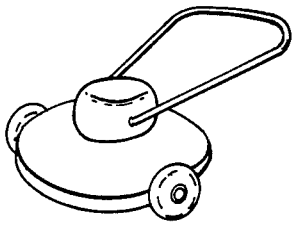
FIG. 7 is again a diagramatic modification illustration.

In FIG. 7 the main means supporting the machine is a pair of treadless low pressure balloon type flotation wheels. The machine operates in the way previously described, but does not hover. The wheels could be made removable so that an operator could use the machine in hovering or non-hovering mode as appropriate to the particular circumstances.

In an inventive modification to the embodiments described and illustrated above, the vent 28 of the FIG. 6 is replaced with a transparent panel of clear plastics material. Such a panel may be held in place by readily removable screws. It gives two advantages in use. Firstly, it gives ready access to the liquid-containing chamber, without the need to remove one of the main sector covers of the hood 11. Thus, for example, a small pump mounted within the chamber beneath such a panel can readily be serviced and checked. Secondly, such a transparent panel enables the user of the machine to observe and monitor the amount of liquid within the liquid-containing chamber, without having to stop the machine and without having to raise or remove the panel.

FIG. 6, taken in conjunction with the above description, adequately illustrates such a modification.

We claim:

1. A machine for removing liquid from an area of ground over which the liquid has spread, the machine comprising:

(a) a hood with a peripheral edge, essentially unapertured and generally dished to define in use the top and sides of the machine;

(b) a tray, generally flat, with a peripheral edge and an aperture at its centre;

(c) means mounting the tray within the hood such that the underside of the machine is defined by the tray, and that an annular gap is maintained between the peripheral edge of the tray and the peripheral edge of the hood;

(d) a motor driven fan mounted at a center portion of, and inside, the hood for blowing air down the central aperature and for drawing substantially all the said air up through the annular gap and across the inside of the hood in a continuous path;

(e) a wall, formed at the peripheral edge of the central aperture and rising towards the fan to duct the fan-blown air through the aperture and across the underside of the machine towards the annular gap;

(f) another wall, formed around the tray peripheral edge and rising therefrom to duct the air entering the annular gap upwardly towards the underside of the hood;

(g) a chamber, defined between the tray walls, to receive liquid drawn with the air into the annular gap and carried over the tray's peripheral wall; and (h) means maintaining a passage for the in-drawn air to blow over the top of the peripheral tray wall across the inside of the machine and into the fan.

2. A machine in accordance with claim 1 and in which the downdraft also provides the main means supporting the underside of the machine above the ground as the machine moves over the ground in use.

3. A machine according to claim 1 and including means positively preventing the liquid from travelling fully across the inside of the machine and reaching the fan.

4. A machine according to claim 3 and in which said means comprise a baffle positively deflecting the liquid into the liquid receiving chamber once the liquid has been carried over the peripheral wall of the tray.

5. A machine in accordance with claim 1 and characterized in that the liquid receiving chamber is defined by the tray walls and the tray itself.

6. A machine in accordance with claim 1 and characterised by the feature that a transparent panel is incorporated into the hood, in a region of the hood above the liquid-containing chamber, and is so positioned as to afford to a user of the machine a view of part of the chamber, thus enabling him to observe and monitor the amount of liquid within the chamber.

* * * * *